United States Patent [19]

Westerlund et al.

[11] 4,345,883

[45] Aug. 24, 1982

[54] HIGH PRESSURE PUMPING APPARATUS FOR SEMI-FLUID MATERIAL

[76] Inventors: Robert E. Westerlund, 10904 N. Westview 41W, Mequon, Wis. 53092; Wayne L. Read, 4913 Hillside Rd., West Bend, Wis. 53095

[21] Appl. No.: 47,301

[22] Filed: Jun. 11, 1979

[51] Int. Cl.[3] ..... F04B 7/04; F04B 49/00

[52] U.S. Cl. ..... 417/317; 417/515; 417/519

[58] Field of Search ..... 417/516–519, 417/339, 345, 346, 317, 900

[56] References Cited

U.S. PATENT DOCUMENTS

| | | | |
|---|---|---|---|
| 2,033,338 | 3/1936 | Kirby | 417/317 |
| 2,442,916 | 6/1948 | Buchanan | 417/346 |
| 2,579,670 | 12/1951 | Hjarde | 417/345 |
| 2,660,955 | 12/1953 | Kent et al. | 417/346 |
| 2,819,835 | 1/1958 | Newhall | 417/346 |
| 3,298,322 | 1/1967 | Sherrod | 417/900 |
| 3,429,267 | 2/1969 | Zinga | 417/900 |
| 3,663,129 | 5/1972 | Antosh | 417/516 |
| 4,174,788 | 11/1979 | Casagrande | 417/900 |
| 4,178,142 | 12/1979 | Schwing | 417/519 |

*Primary Examiner*—William L. Freeh

*Attorney, Agent, or Firm*—Andrus, Sceales, Starke & Sawall

[57] ABSTRACT

Concrete is transmitted from a hopper forming a part of a mobile concrete pumping apparatus to the deposit site through a flow line having a Y-pipe inlet. The pumping apparatus includes two piston-cylinder concrete pumps mounted in side-by-side relationship adjacent the hopper, which has an auger to rapidly charge a pump with concrete through one of two discharge pipes. Each pump is pivotally mounted, to locate the cylinder aligned with the discharge pipe or with one inlet of the Y-pipe inlet. Each pump has a valve plate pivoting with the cylinder to alternately close the hopper opening and the inlet line. Hydraulic cylinder units are coupled to the valve plates to pivot the pumps. A floating valve plate has coupling pipes attached to the hopper and a hydraulic cylinder urges the same into sliding sealing engagement with the rotating valve plate. The pumps are individually, alternately and oppositely positioned for charging and discharging, with a common discharge period at the end of the one pump unit and start of the other pump unit.

6 Claims, 11 Drawing Figures

Fig. 1
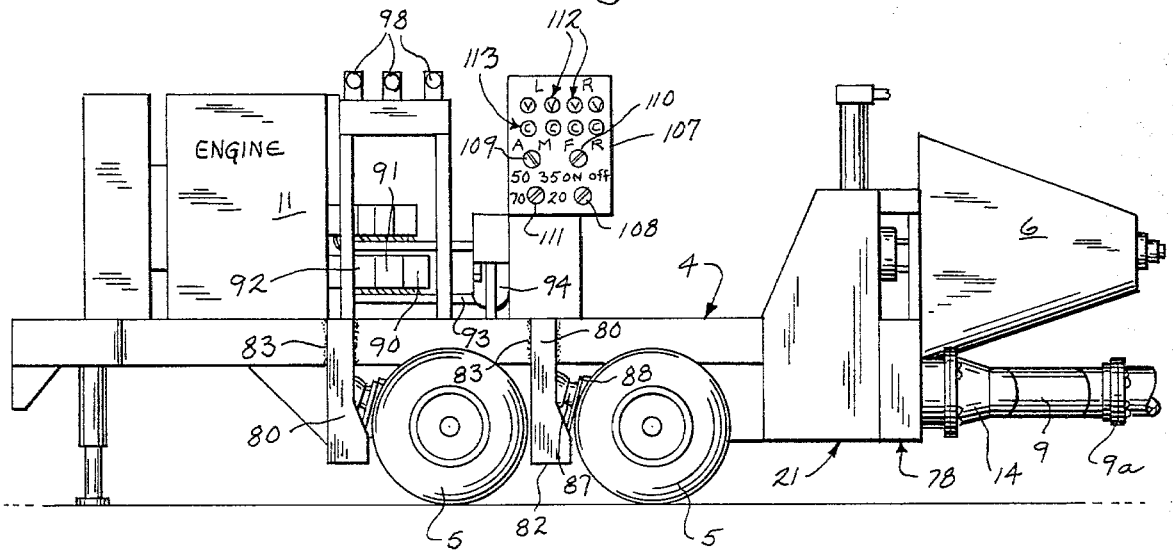
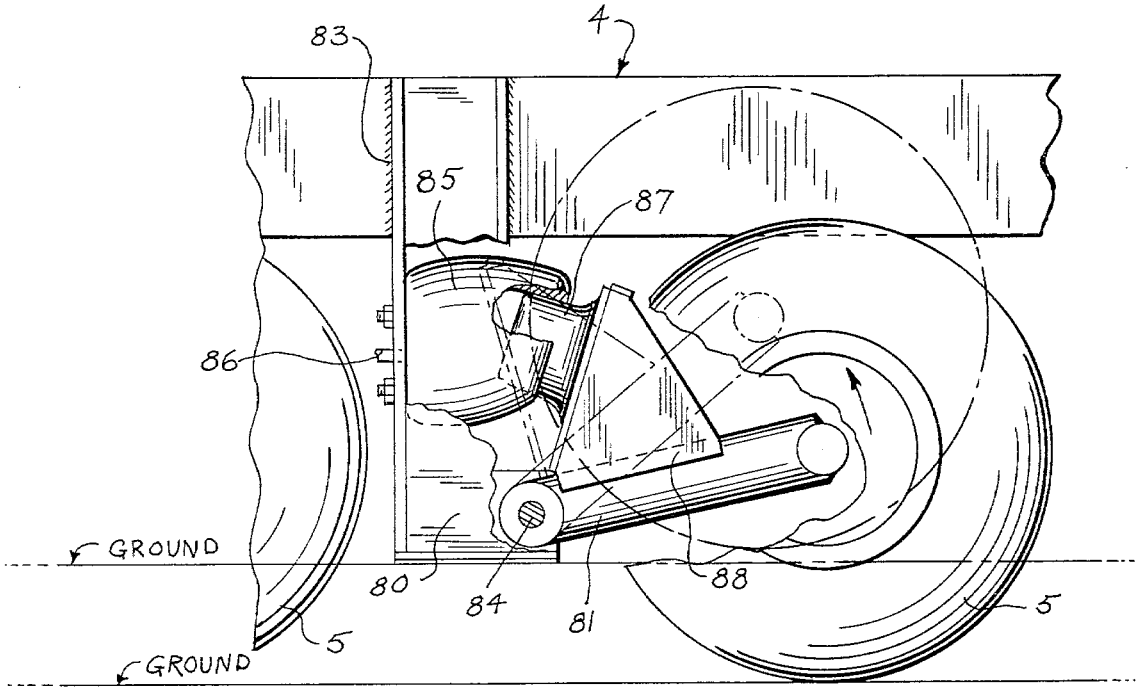
Fig. 2

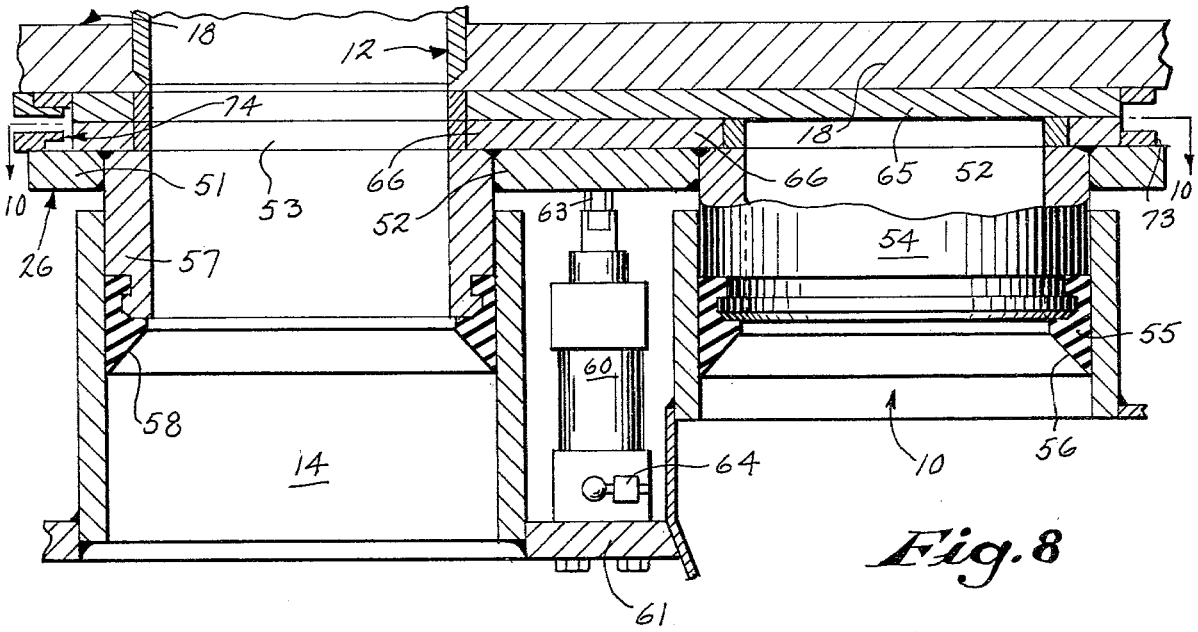
Fig. 8
Fig. 7
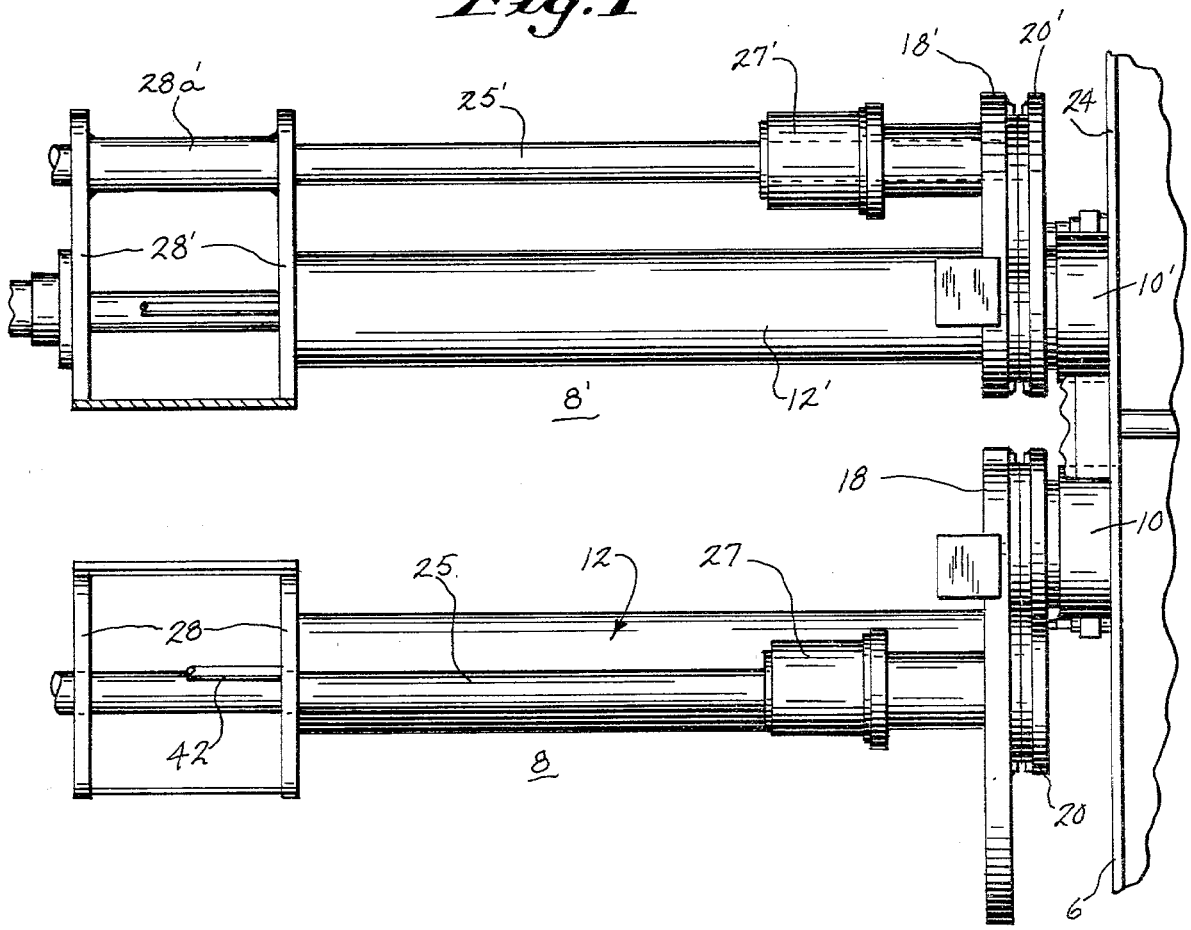

HIGH PRESSURE PUMPING APPARATUS FOR SEMI-FLUID MATERIAL

BACKGROUND OF THE INVENTION

The present invention relates to high pressure concrete pumping apparatus and particularly to such pumping apparatus for transmitting of semi-fluid products such as concrete over relatively long distances.

Cement, concrete, plaster and similar building materials are advantageously transmitted through suitable flow lines from a central source, such as a mixing station or dump site to the deposit location. For example, in bridges, tall buildings and other structures, the transport of the material in batches was the normal method of carrying the materials for many years. However, concrete pumping apparatus has been developed which permits more or less continuous delivery of such material through a flow system constructed at the site. In many applications relative long pumping lines are required for carrying the concrete from a central location to the deposit site. Further, the flow path may includes substantial vertical rising portions. For example, in the construction of cooling towers for nuclear power stations, the concrete has been historically raised through the use of buckets carried by suitable elevating means such as temporarily installed elevators, cranes and the like. In addition to being time consuming, such batch systems may create dangerous environments. Thus, if a concrete-filled bucket at the end of a crank inadvertently swings and strikes the structure, severe damage can result to both the property and the workmen. The pumping of concrete substantially eliminates such problems. Concrete pumping systems generally include positive displacement pumps to produce flow through the lines and various means have been suggested to create constant movement and delivery. Generally, multiple pumping arrangements have been suggested with alternate pump operation, and in some instances overlapping operation, provided in an attempt to develop essentially constant delivery of the pump material. Different systems use mechanical interlocks to effectively transfer the motion between the several pump units. Alternatively, various valving and interlocking flow mechanisms are used in the attempt to maintain the constant flow.

Generally, the prior art pump units involve some slight delay during the pumping cycles in which the pumping force decreases or drops sufficiently to permit effective stopping of the flow through the system. When the outward pumping action is again initiated, even though only a momentary delay is involved, substantial and significant inertia and friction forces within the system must be overcome.

The flow characteristics of the concrete or other similar semi-fluid material thus establish significant loads on the pumping system and may result in a complete failure of flow, with a resulting down time as well as relatively costly system clean-out required.

Another very significant factor which arises from the usual flow characteristic is the pulsating or recoil forces on the flow lines. The varying forces in flow cause movement of the flow line. Under certain conditions, the flow line movement is often sufficiently great as to creat a hazardous condition. For example, with the flow line attached to a structure for carrying of concrete to the upper or top portion, the line movement may shake the building. For example, shaking of previously set concrete may result in a force which breaks the bond between the concrete and the reinforcing rods, with the resulting weakening of the structure. With present systems, the elbows of the flow line system are embedded in relatively massive reaction blocks to minimize line movement. Such a system for example is disclosed in an article at page 379 of Concrete Construction magazine of June, 1979. As more fully described therein, a coupling elbow is advantageously embedded in a reaction block formed of more than one yard of concrete. Thus, an 8,000 lbs. concrete reaction block serves to firmly support and stabilize the flow line, minimizing the movement of the line and thereby shaking of the interconnected elements. In other applications, one or two men may be placed on the flow line to steady and support the line during the pumping operation. Even with two men, the pulsating effect may be so great as to create a force capable of knocking the men over. Further, the flow line must often be repositioned, at least at the upper end for most advantageous depositing of the concrete. It is therefore desirable to have a line system which can be crane mounted. Obviously with the highly pulsating effect associated with many conventional systems, crane mounting is difficult if not impossible unless very special crane constructions and supports are supplied.

In summary, the pulsating effect associated with the conventional prior art flow systems not only create problems within the pumping system but create very significant problems in connection with the associate components and personnel, all which have required rather special consideration and expense.

Further mechanical devices inherently are subject to wear, particularly in the environment of harsh materials such as concrete. Thus, even though the devices might operate satisfactorily when first constructed if sufficient attention has been given thereto, the components may rapidly lose the original characteristic. A lack of a significant operating life will of course prevent practical implementation of a design.

Thus, although the concrete pumping apparatus provides improved movement of concrete over the conventional bucked system and such apparatus is widely used in building and rod constructions, concrete pumping apparatus is not presently available which is particularly satisfactory for job application in which relatively long distances or significant vertical heights are encountered.

SUMMARY OF THE INVENTION

The present invention is particularly directed to positive displacement semi-fluid pumping means including a plurality of pumping units with completely separate but interrelated driving controls to develop appropriate timed operation of the controls and pumping units such that overlapped operation of the individual pumping units establishes and maintains a constant outward flow of semi-fluid material through the system over the total operating period. The present invention permits the pumping of highly abrasive and semi-fluid materials such as plaster, cement and particularly concrete over long distances as well as short distances. The invention is therefore described hereinafter with reference to pumping concrete. Generally, in accordance with the teaching of the present invention, each pumping unit is connected to a positioning and driving means. The pumping units are movably mounted for selectively coupling between a concrete source and an input to a transfer flow system. Each pumping unit is individually charged and discharged. The units, however, are constructed such that each is moved to a discharge position during the terminal discharging portion of the alternating unit and actuated to initiate a discharge before complete discharge of the first unit. Thus, there is a slight overlapping period when both units are discharging. At the end of such overlapping, the completely discharged unit is transferred or moved to a charging position, and separately and independently charged at a rate significantly greater than the discharging period such that it is charged prior to the complete discharge of the then discharging unit. The newly charged pumping unit is then moved into the discharge position and discharge thereof initiated just prior to the final discharge of the then discharging unit. The charging and discharging of the pumping units is separately and independently controlled as far as the pumping units are concerned. The overlapping time of operation is controlled within the controlled unit to permit accurate controlling thereof. This individual positioning and operation of the pumping units permits use of a simple and reliable valve means and accurate selective coupling of the pump units to the transfer flow system.

Although other forms and embodiments of the invention may include the above features of this invention, a preferred and particularly unique embodiment of the present invention includes a pair of pumping means such as pair of piston-cylinder pumping units and individual hydraulic piston-cylinder driving units. The pair of pumping units are mounted in side-by-side relationship to a power feed concrete supply unit. The pumping units and a hydraulical supply system are mounted on a support, which is peferably a mobile chassis for transport of the assembly. The concrete supply unit is pivotally attached to the chassis for swinging of the supply unit into operative coupling to the pair of pumping units. The source may, for example be a common hopper having an auger drive for forcing of the concrete to a pair of appropriate side-by-side located hopper discharge openings. Each of the pumping units is pivotally mounted, with the pumping cylinder pivoted between a discharge opening of the hopper unit and a laterally located input line of the outlet flow system. The individual input lines merge into a common flow line for transmission of the concrete to the deposit site. Each pumping unit includes an integrated swinging or rotating valve plate assembly which pivots with the pumping cylinder and moves selectively into overlying relationship to the hopper opening and the siamese inlet line. Individual hydraulic cylinder positioning units are provided and coupled to the rotating valve assemblies to selectively position the pumping means and particularly the pumping cylinders for charging and discharging. The hydraulic cylinder units are coupled to a suitable hydraulic power supply and control for establishing proper timed rotation of the valve plate assemblies and interconnected cylinders. The hydraulic power supply, in one feature which may be provided, includes valve means to control the rate of flow of hydraulic fluid for accurately adjusting the timing of the movement of the cylinder units. A floating valve plate assembly includes a telescoping coupling conduit means projecting into the hopper opening and into the siamese input line. The floating valve plate assembly is mounted for limited floating movement and a pressure means is provided for continuously urging the floating valve plate assembly into sliding engagement with the rotating valve plate assembly. The rotating valve plate assembly, and floating plate assembly, may be also formed as a unique assembly including a base support plate integrally connected to the pumping cylinder and to which the positioning unit is connected for pivoting of the assembly. A wear plate is releasably clamped to the support plate with an adjustment means permitting the accurate alignment of the wear plate openings with the pumping cylinder. In a particular embodiment, a hydraulic cylinder means is also connected to the floating valve plate and continuously forces the floating valve plate into engagement with the rotating valve plate assembly and particularly the replaceable wear plate. An auxiliary resilient seal ring may be provided about one wear plate. The pumping cylinders are alternatively coupled to the hopper for charging and to its corresponding system inlet line for discharge of the concrete.

As noted above, the preferred embodiment includes a movile chassis with the hopper mounted to one end by a suitable swinging support. The hydraulic equipment is mounted to the opposite end of the chassis to distribute the weight and provide a balanced load for ease of transport and on-site stability.

Additionally, the supporting wheels for the mobile unit are preferably constructed with pivoting axle arms which pivot on a transverse axis. The wheels are thereby mounted for swinging of the wheels down into a transport position and upwardly to lower rigid, stable support legs onto the ground during a pumping operation. A wheel positioning power means preferably includes a sealed pneumatic air bag secured to the support legs and a piston projecting into the bag as a rolling diaphragm and secured to the axle arms.

The system can be provided with any type of automatic sensing and operating control. For example, suitable limit switches can readily be provided on the output of hydraulic cylinder unit of the pump units to provide position related signals for the related concrete pump. These signals may be applied to the control system which in turn provides for proper connection of the hydraulic supply to pumping and the positioning cylinders. Further, the hydraulic flow system is preferably constructed with flow rate control valves to vary the interrelated seed of the several units to adjust the concrete pumping rate as required for a given installation.

The present invention provides a reliable means of maintaining proper and complete synchronous movement of the pump units for establishing and maintaining a constant flow characteristic.

The present invention particularly provides a reliable and highly effective concrete pumping apparatus for maintaining a constant flow of concrete through the transfer flow system.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings:

FIG. 1 is a side elevational view of a concrete pumping apparatus constructed in accordance with the present invention;

FIG. 2 is an enlarged fragmentary view illustrating the wheel support for the mobile unit shown in FIG. 1;

FIG. 7 is an enlarged fragmentary top view taken generally on line 7—7 of FIG. 3;

FIG. 8 is an enlarged sectional view taken generally on line 8—8 of FIG. 9;

DESCRIPTION OF ILLUSTRATED EMBODIMENT

Figure 3:
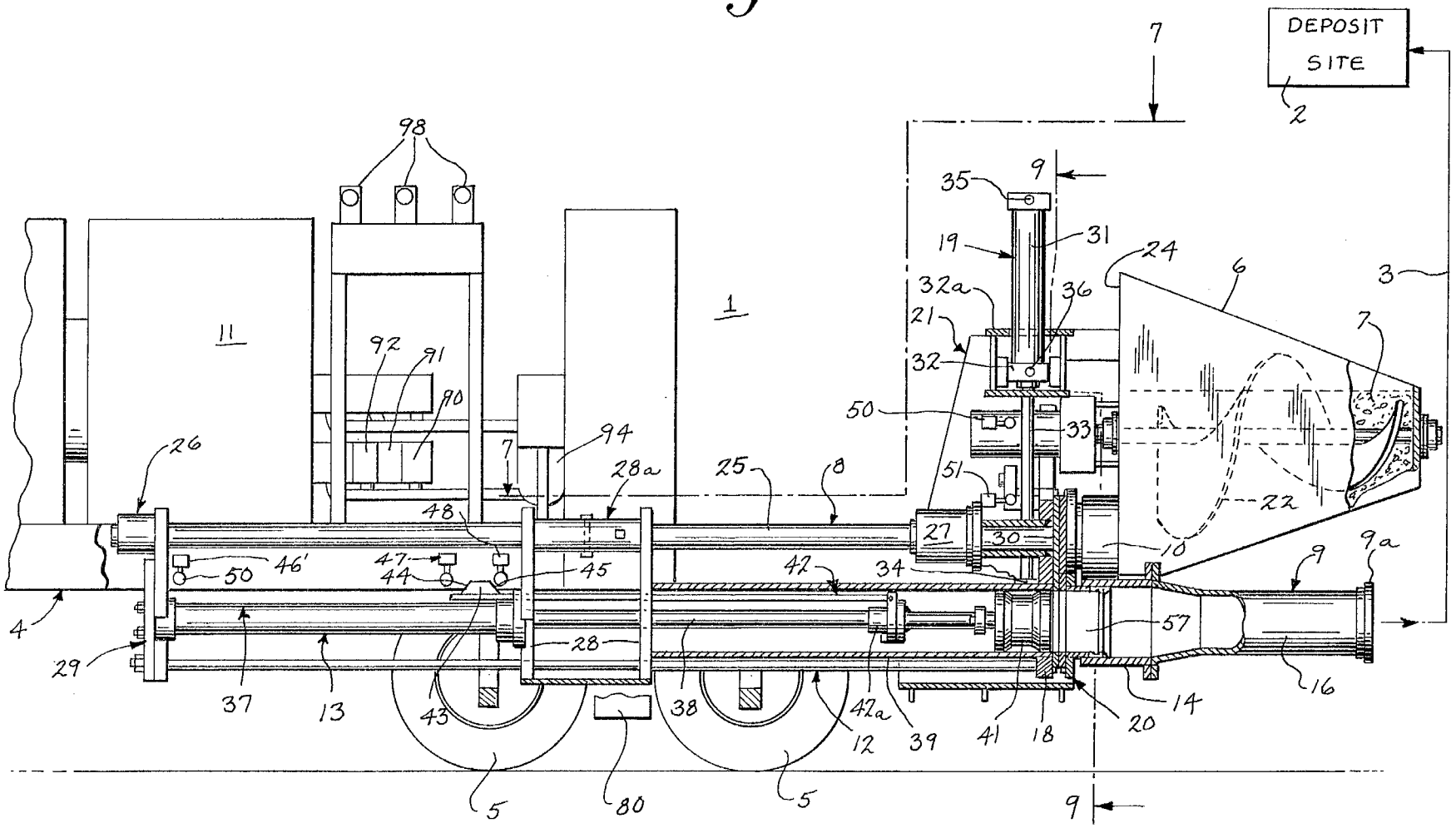
FIG. 3 is an enlarged side elevational view with parts broken away and sectioned to show details of construction.

Referring to the drawings and particularly to FIGS. 1, 2 and 3, a mobile concrete pumping apparatus 1, illustrating a preferred embodiment of the present invention, is shown. In FIG. 3, the apparatus is diagrammatically illustrated connected to a remote deposit site 2 by an interconnecting flow line 3. The illustrated pumping apparatus is a mobile assembly including a basis supporting chassis or framework 4 provided with suitable support wheels 5. The support wheels 5 are mounted for vertical movement, to establish a mobile support as in FIG. 1 and a stable pumping support as in FIG. 3. As the support structure can be of any suitable or desired construction which can be readily provided by those skilled in the art, the support is not shown in detail and is described herein as necessary to set forth particular features of the preferred construction.

Figures 4, 10:
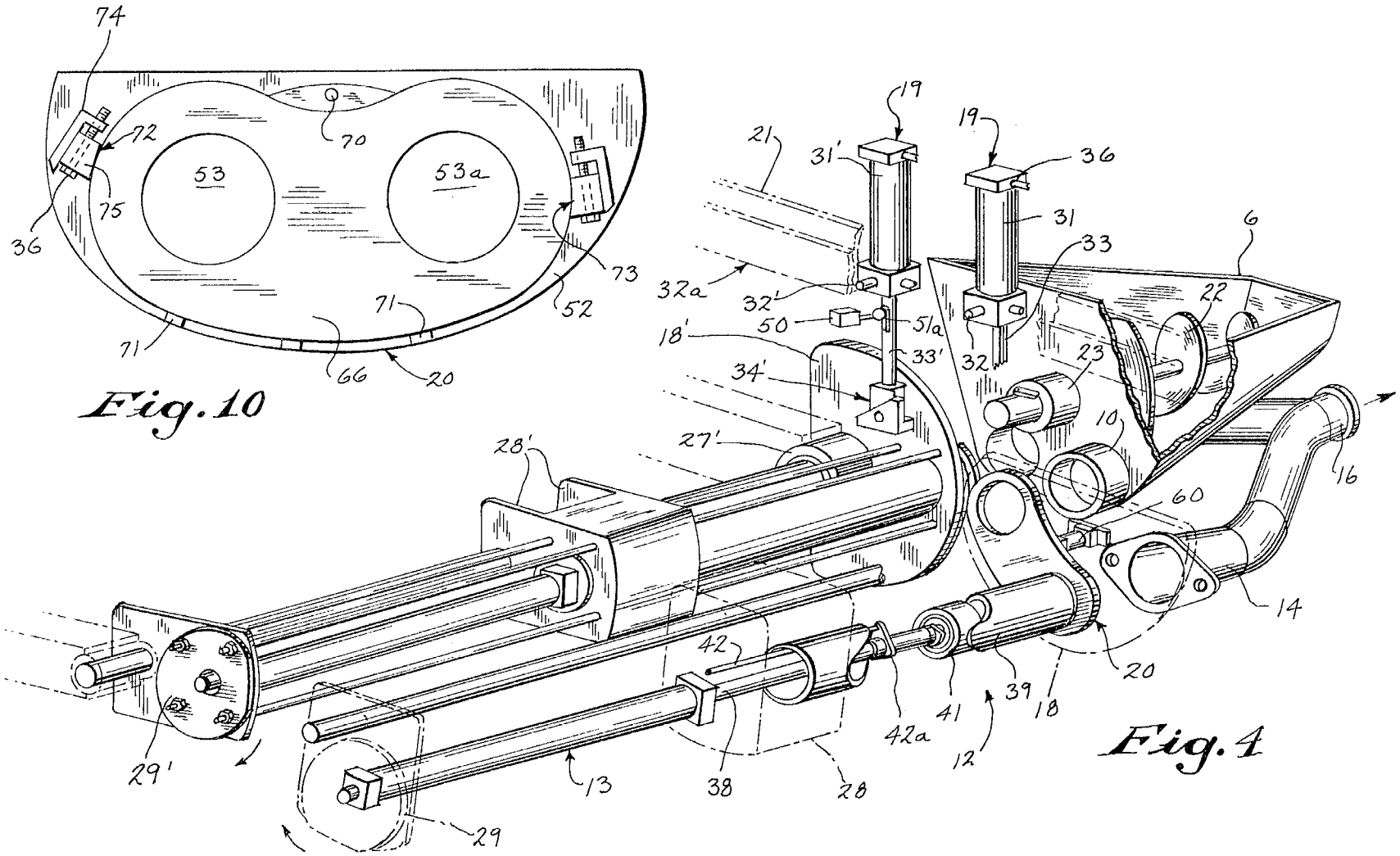
FIG. 4 is a pictorial view of portions of the pumping apparatus shown in FIGS. 1 and 3.
FIG. 10 is a fragmentary view taken generally on line 10—10 of FIG. 8.

A concrete hopper 6 is mounted to the end of the frame, hereinafter referred to as the back end, within which semi-fluid concrete 7 is held as a continuous source or supply. Thus, concrete 7 is poured into the hopper through an opened top from any source, such as is conventionally used in the trade. Referring to FIGS. 3 and 4, the embodiment of the present invention shown includes first and second concrete pump assemblies 8 and 8′ mounted immediately forwardly of and coupled to hopper 6. Pump assemblies 8 and 8′ are operable to remove the concrete 7 and deliver the same under pressure, such as 500 pounds per square inch (psi) to an input pipe or line unit 9 of an inch flow line system 3 secured immediately beneath the hopper unit 6 as a part of the pumping apparatus. The pumping assemblies 8 and 8′ are individually and similarly constructed and uniquely mounted, for individual and separately controlled movement, to the supporting frame 4 as more fully described herein. The structure of pump assembly 8 is therefore described in detail, with the corresponding elements of the pump assembly 8′ identified and referred to by corresponding prime numbers.

Generally, the pumping assemblies 8 and 8; are selectively coupled to the hopper 6 and the discharge flow line 3 through the inlet pipe unit 9 shown as a siamese or Y-shaped pipe assembly terminating in a common discharge pipe connection 9*a* to the input end of the transfer line 3 immediately adjacent the pumping apparatus 1. The hopper 6 is provided with a pair of side-by-side openings having projecting coupling or discharge pipes 10 and 10′ for selective supply of concrete to the pump assemblies 8 and 8′. Referring particularly to FIGS. 3 and 4, pump assembly 8 is shown as a piston-cylinder construction adapted to be driven from a high pressure hydraulic supply unit 11 mounted on the frame 4 immediately adjacent the forward end of the chassis. The hydraulic supply unit 11 is diagrammatically illustrated as a suitable engine driven assembly mounted to the forward portion of the frame 4. The weight of several elements and including the hopper assembly 6, the pumping assemblies 8, 8′ and the hydraulic power supply unit 11 are properly distributed to create a balanced load or weight within the pumping apparatus. The apparatus 1 is thus a stable assembly both in the transport position and in the operating position.

The pump assembly 8 includes concrete pump unit or section 12 and an actuating power section 13, the latter of which is suitably connected to hydraulic supply unit 11 for operating of power section 13. The pumping assembly 8 is pivotally mounted for selectively aligning of the pump unit 12 with the hopper openings 10 and alternatively with an inlet pipe 14 of the transfer pipe unit 9. Pump assembly 8′ is similarly pivotally mounted and positioned between hopper opening 10′ and an inlet pipe 15 of the Y-shaped pipe unit 9. Thus, the pipes 14 and 15, of course, merge into a suitable common pipe 16 connected to the common discharge connection 9*a*, and thereby to the inlet end of the line 3.

Referring again to pump assembly 8, a rotating valve plate 18 is secured to the pump section 12 and pivots therewith. The valve plate 18 extends to the opposite side of the cylinder opening and includes a flat front wall which functions to close the hopper opening 10 or the inlet pipe 14 when either of the latter is not aligned with the pump section 12.

In the illustrated embodiment of the invention, a hydraulic actuator 19 is coupled to the rotating plate 18. The actuator is connected to hydraulic power source 11 and operated to selectively pivot the total assembly including the rotating valve plate 18 and the pump assembly 8 to appropriately and alternatively align the pump unit 12 with the opening 10 and the inlet pipe 14.

A floating valve plate assembly or unit 20 is located between the rotating valve plate 18 and the hopper opening 10 and inlet pipe 14 to seal the connection and prevent leakage of concrete during the pumping operation.

The pump assembly 8′ is similarly mounted to the opposite side of the frame 4 with the actuator 19′ selectively aligning the pump unit 12′ with the hopper opening 10′ and the inlet pipe 15.

The hydraulic actuator units 13, 13′ and 19, 19′ are operated in appropriate timed and sequential relation to provide for the alternate charging and discharging of the pumping sections 12 and 12′ in alternate relationship to establish and provide a continuous flow of concrete from the hopper 6 and through the pumping apparatus 1 into the line 3, without any delay or hesitation in the outward flow. This, of course, eliminates the undesirable problem associated with overcoming static friction and the inertia forces associated with a nonflowing semi-fluid concrete within the flow line 3.

Generally the sequence includes three different distinct stages. Referring for example to FIGS. 3 and 4, pump assembly 8 is shown in a discharging position for discharging of the semi-fluid concrete into the inlet pipe 14 and through the Y-shaped pipe unit 9 to the flow line 3. At this period, the pumping section 12′ of assembly 8′ is aligned with the hopper opening 10' and is being charged with the semi-fluid concrete. Prior to complete discharge and emptying of pump section 12, the pump section 12' is completely filled. The actuator 19' is then actuated and rotates the pump assembly 8' from the charging position to the discharging position, aligned with the inlet pipe 15 of the Y-shaped pipe unit 9. This alignment is completed prior to the complete cycle of the pumping section 12, and pump section 12' is actuated prior to the complete discharge of the section 12 such that concrete simultaneously flows through both branches to line 3. Thus, the two units 8 and 8' are operated simultaneously to create continuous flow of concrete, with section 12' continuing to discharge after the section 12 has been completely discharged. When pump assembly 8' is discharging, pump assembly 8 is pivoted from the discharge position illustrated in FIG. 3 to the charging position with the section 12 aligned with the hopper opening 10. The third state is thus created with pump assembly 8' solely discharging into the pipe 15 of unit 9 and line 3 with its hopper inlet opening 10' closed by the valve plate 18', and the pump assembly 8 charging, with its inlet pipe 14 of unit 9 closed by valve plate 18. During the movement of the pump assemblies 8 and 8', rotating valve plates 18 and 18' are engaged with the floating valve plate units 20 and 20' to maintain a positive and reliable seal at the respective connection such that there is no loss of the concrete from the system.

More particularly in the illustrated embodiment of the invention, the mobile assembly may include a mounting framework 21 secured to the front end of the frame 4. Framework 21 may include a front plate and suitable side plates to create a suitable rigid support for the various components such as the actuators 19 and 19', pivot supports for the adjacent end of assemblies 8 and 8' and the like. Hopper 6 is shown as a conventional open-top housing mounted in front of the assembly 21 and thus adjacent the assemblies 8 and 8'. In the preferred embodiment of the present invention a positive discharge of the concrete 7 from hopper 6 is provided. In the illustrated structure, an auger 22 is rotatably mounted within the hopper 6 and coupled to a suitable hydraulic drive motor or other suitable drive 23. Motor 23 is operative to continuously rotate the auger 22 for positive forcing of the concrete 7 toward the discharge hopper openings 10 and 10'. The hopper 6 thus includes a front vertical wall 24 with the hopper openings 10 and 10' located within such wall for selective coupling to the respective pump assemblies 8 and 8'. Auger 22 provides a positive feed of the concrete to the assemblies 8 and 8' as well as for providing for a continuous mixing and remixing of the concrete mix.

As most clearly shown in FIGS. 3, 4 and 7, pump assembly 8 is mounted by a pivot shaft 25 which is fixedly supported to the opposite ends upon the frame 4 in any suitable manner. In the illustrated embodiment of the invention, a support journal 26 is secured to the front end of frame 4 for supporting the one end of the shaft 25. A back pivot block or journal 27 is similarly secured to the frame 4 to support the back end of the pivot shaft 25. The pump section 12 and the actuating section 13 are interconnected to each other and to central pivot support plates 28 connected by a common pivot sleeve or pivot journal **28*a* secured between the plates and bolted to shaft 25 to pivot therewith and pivotally mounted on the shaft 25**.

The section 13 includes a support plate 29 which projects therefrom and is attached to and pivots with the shaft 25. The back end of shaft 25 is affixed to the valve plate 18 as at 30 which in turn is coupled to the actuator 19. Thus, operation of actuator 19 operates to pivot the plate 18 and attached shaft 25, which correspondingly pivots the pump assembly 8.

The pump assembly positioning actuator 19 is also a piston-cylinder unit including a cylinder 31 pivotally mounted, as by pivot pin 32 to a cross-brace assembly **32*a* forming a part of the front wall assembly 21. The piston rod 33, connected within cylinder 31 to a piston, not shown, projects downwardly with the outer end pivotally interconnected by a suitable pivot bracket to valve plate 18 as at 34. The hydraulic cylinder 31 is provided with suitable hydraulic connectors 35 and 36 at the opposite end, and connected to the motor-driven supply unit 11. The control selectively supplies hydraulic fluid to the opposite ends of the cylinder 31 for selective reciprocation of the piston rod 33 and thereby pivots plate 18, attached shaft 25 and attached pump assembly 8**.

The pump operator section 13 of pump assembly 8 is similarly a piston-cylinder unit having a cylinder 37 rigidly affixed to the back pivot plate 39 and to the one plate. A piston rod 38 projects outwardly through the central pivot assembly **28-28*a* and is coupled to operate pump section 12. Pump section 12 is also a piston-cylinder unit having a cylinder 39 rigidly mounted to the second plate 28 at the outer end and in valve plate 18 at the opposite end. The cylinder 39 is open and aligned with a corresponding opening 40 in the valve plate 18. A piston 41 is secured to the extended end of actuator rod 38 and reciprocally mounted within the cylinder 39. Piston 41 is thus positioned by the actuation of the operation section 13 to selectively withdraw and force the concrete 7 into and from cylinder 39**.

The piston-cylinder units for the actuation section 13 and the section 12 may be of any known or desired construction and in actual practice can readily be provided by those skilled in the art. Consequently, no further detailed description or illustration is given.

In the illustrated embodiment of the invention, the position of the pump assemblies 8 and 8' are continuously monitored to permit appropriate timed positioning and operation thereof. As shown most clearly in FIG. 1, a limit switch actuating rod 42 is releasably secured by a bracket **42*a* to the piston rod 38. The rod 42 extends rearwardly through the pivot plate 28. A switch actuator 43 is secured to the outer end of rod 42. The actuator 43 is a block-like member having oppositely inclined end surfaces 44 and 45. Suitable control or limit switches are secured in the path of the actuator 43. In the illustrated embodiment of the invention, three switches 46, 47 and 48 are secured in longitudinally spaced relation to supporting frame 4 in the path of the actuator 43. Switches 46-48 are each shown as well-known limit switch units having a pivotally mounted operating arm 49 which extends downwardly into the path of the actuator 43. Switches 46 and 48 are located to the opposite ends of the operating cylinder 37 and thus indicate the full retraction and extension of the piston operator and a corresponding positioning of the concrete pump piston 41 between its two limits. Interlock limit switch 47 is located immediately adjacent to the full discharge end switch 48 to provide an interlock signal within the system and create a timed overlap with the opposite valve or pump assembly 8'**. The switches 46-48 are connected in any suitable control circuit to establish charging and discharging of the concrete 7 from the hopper 6 to assemblies 8 and from assemblies 8 through the Y-pipe unit 9 to line 3.

Figure 9:
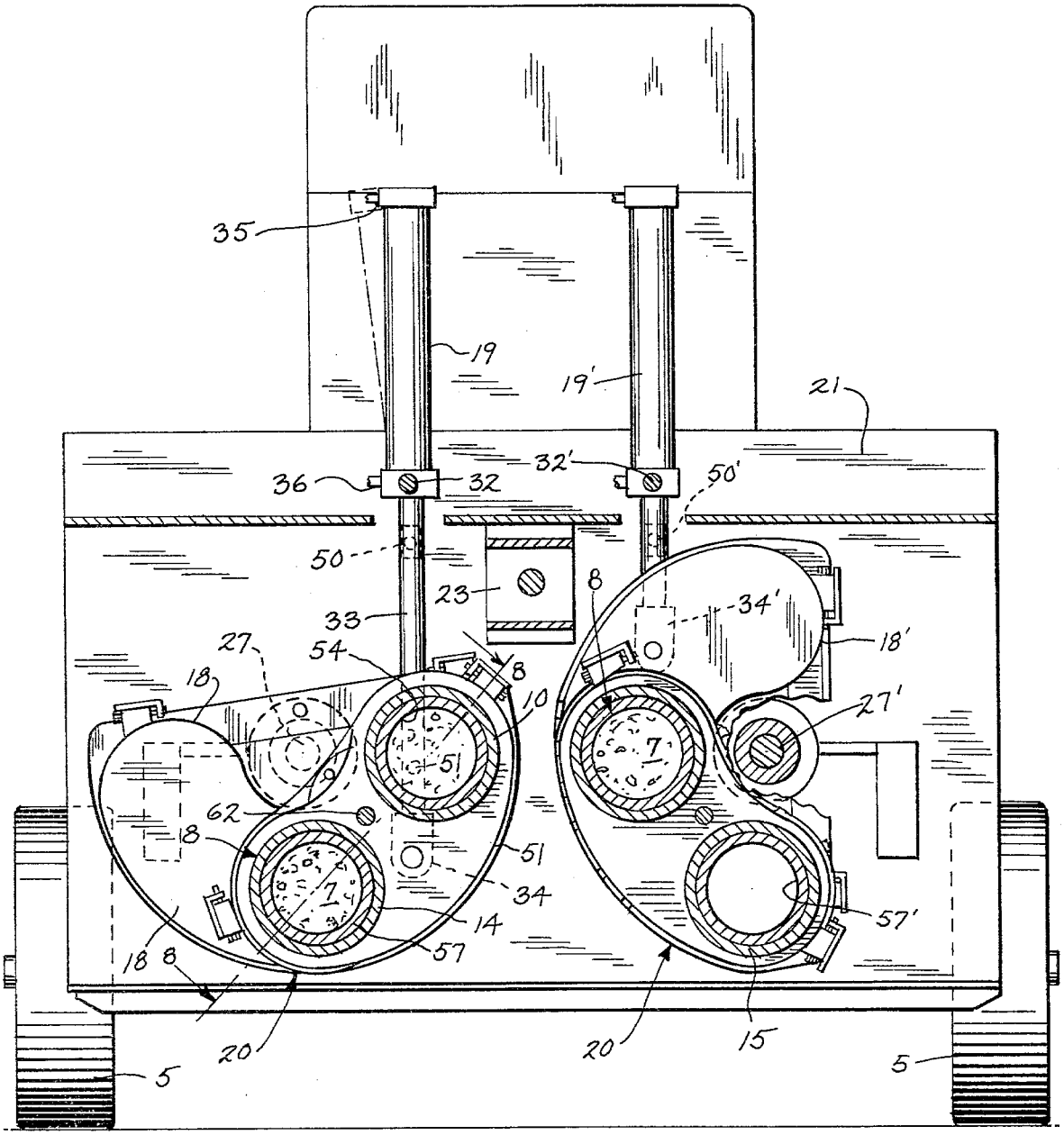
FIG. 9 is a sectional view taken generally on line 9—9 of FIG. 3.

In addition, the rotated position of the assemblies 8 and 8' is monitored by retract and extend limit switches 50 and 51 mounted adjacent the corresponding vertical positioning cylinder unit 19 and 19'. Thus, the piston rods 33 are provided with a suitable actuator 51*a* which moves into engagement with the retract limit switch 50 with the unit 19 fully retracted and with the extended limit switch 51 with the unit 19 fully extended. As shown in FIG. 9, the valve plate 18 is correspondingly positioned to align the pump assembly 8 with the hopper opening 10 in the retracted position and with the inlet Y-pipe unit in the extended position.

As previously noted, the floating valve plate assembly 20 is located between the rotating plate 18 and the opening 10 and inlet pipe 14 to maintain a positive sealed connection during the positioning of the pumping assembly 8 between the charging and discharging positions.

As most clearly shown in FIGS. 4, 7-10, the floating valve plate assembly 20 includes a generally arc-shaped floating valve plate 52 located adjacent to, and in sliding abutting engagement with, the rotating valve plate 18 of pump section 13. The floating valve plate 51 has a pair of openings 53 and 53*a* angularly spaced in accordance with the hopper opening 10 and the inlet pipe 14 of Y-pipe unit 9. A plate coupling conduit or pipe 54 is secured within the opening 53 and extends therefrom into the hopper or outlet pipe 10. The projecting end of the pipe 54 is formed with a notched construction with a resilient sealing gasket 55 having a complementing coupling notched portion secured thereto. The gasket 55 is an annular rubber-like member having a cylindrical outer wall slidably engaging the inner surface of the discharge pipe 10. The gasket 55 projects from pipe 54 and the innermost interior wall is tapered as at 56 to provide a generally feathered edge. Thus, as the concrete 7 is forced out through the opening pipe 54, the pressurized concrete also forces the gasket 55 radially outwardly into firm sealing engagement with the side wall of pipe 54 to firmly seal the discharge opening.

A similar coupling pipe 57 is fixed within discharge pipe 53*a* in alignment with the inlet pipe 14. The pipe 57 thus extends outwardly and includes a corresponding sliding seal 58 within the pipe 14 of the Y-shaped pipe unit 9.

A hydraulic cylinder unit 60 is mounted in fixed relation to the hopper 6 and supporting frame structure 4 as by bracket 61. A piston rod 62 projects outwardly and is interconnected by connecting stud 63 to the floating valve plate 52. The hydraulic cylinder unit 60 is connected to the output of the engine driven source 11 through a suitable pressure regulating valve 64 to maintain a constant outward pressure on the floating plate 52 and thereby maintains the plate in firm and sliding engagement with the rotating valve plate 18.

The continuous pivoting of the pump assembly 8 will eventually create some surface abrasion, and may eventually result in a significant breakdown of the sealing effectiveness. As illustrated, the rotating valve plate 18 and the floating valve plate 52 are similarly formed with replaceable face plate. Referring particularly to FIG. 8, a face plate 65 is releasably mounted and forms the front opposed sliding face of plate 18. Similarly, in FIGS. 8 and 10, plate 52 has a face plate 66 releasably mounted and forms the front opposed sliding face of plate 65. The releasable plates 65 and 66 may thus be formed with hardened and relatively highly finished surfaces to produce an effective seal against outward flow of the concrete, including the water content. The plate may, of course, be formed of other suitable materials and finishes. Thus, one or both plates may be formed of relatively soft metal such that any abrasion or wear may occur on such plate or plates, with appropriate replacement when necessary. In the event of any wear within the sliding seal structure, the outer wear plates can be readily replaced. The wear plates 65 and 66 have openings which are in precise alignment with the opening in the plates 18 and 52. The plates 65 and 66 are similarly releasably clamped in place, and the clamp structure for the floating valve plate unit is shown in FIG. 10 and described for purposes of explanation.

Plate 52 includes a pivot pin 70 located above and between the hopper and transfer inlet openings 10 and 14. A series of guide pins 71 are located to the opposite side of plate 52. Similar clamps 72 and 73 are located to the opposite sides of the wear plate 66. Referring to clamp 72, an L-shaped support 74 is secured to the plate 52 opening toward the edge of plate 66. A wedge 75 is located between the clamp support 74 and the edge of plate 66. A positioning bolt 76 is threaded through wedge 75 and rotatably fixed in the cross leg of the support 74. Rotation of the bolt 76 thus forces the wedge 75 between the fixed support 74 and the plate 66 to pivot the plate. The opposing clamps 72 and 73 thus permit accurate positioning of the wear plate 66 into precise alignment with openings 10 and 14.

Figure 6:
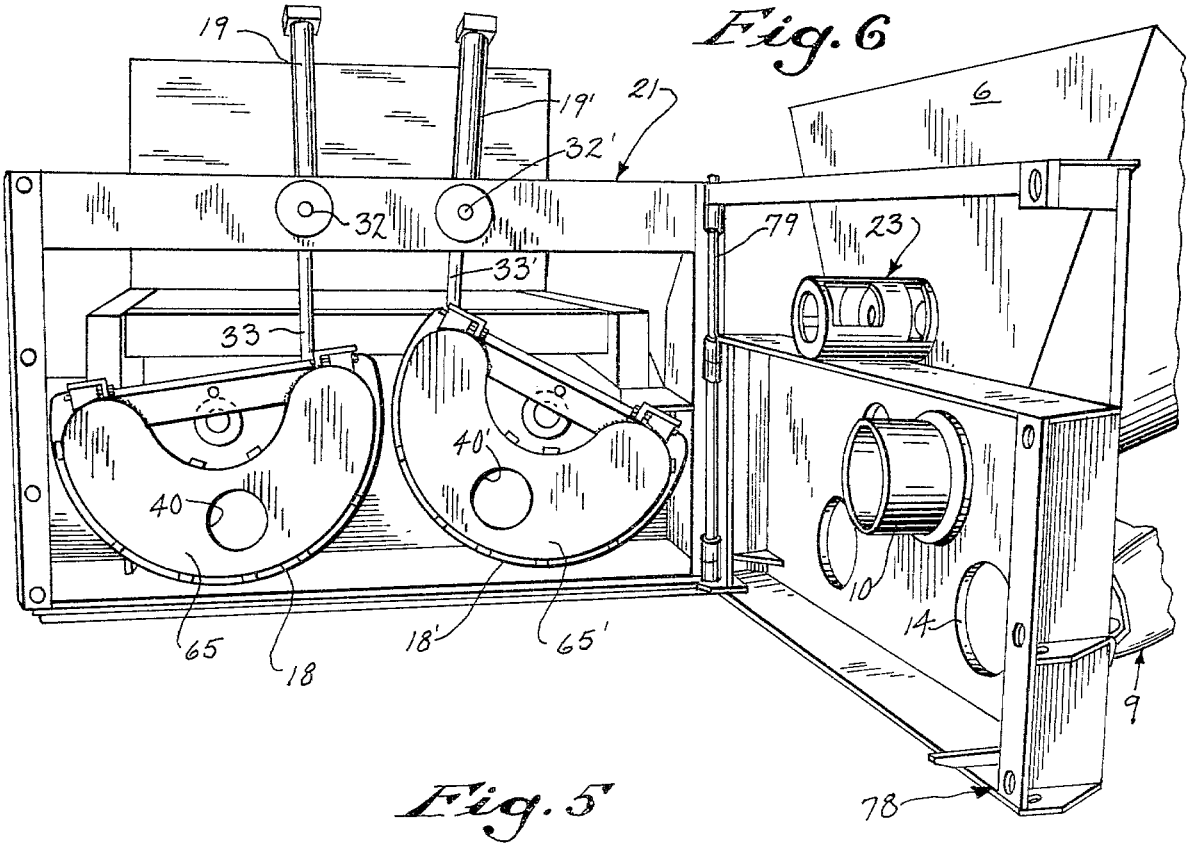
FIG. 6 is a view similar to FIG. 5 showing the hopper unit swung open for access to internal components.
Figure 5:
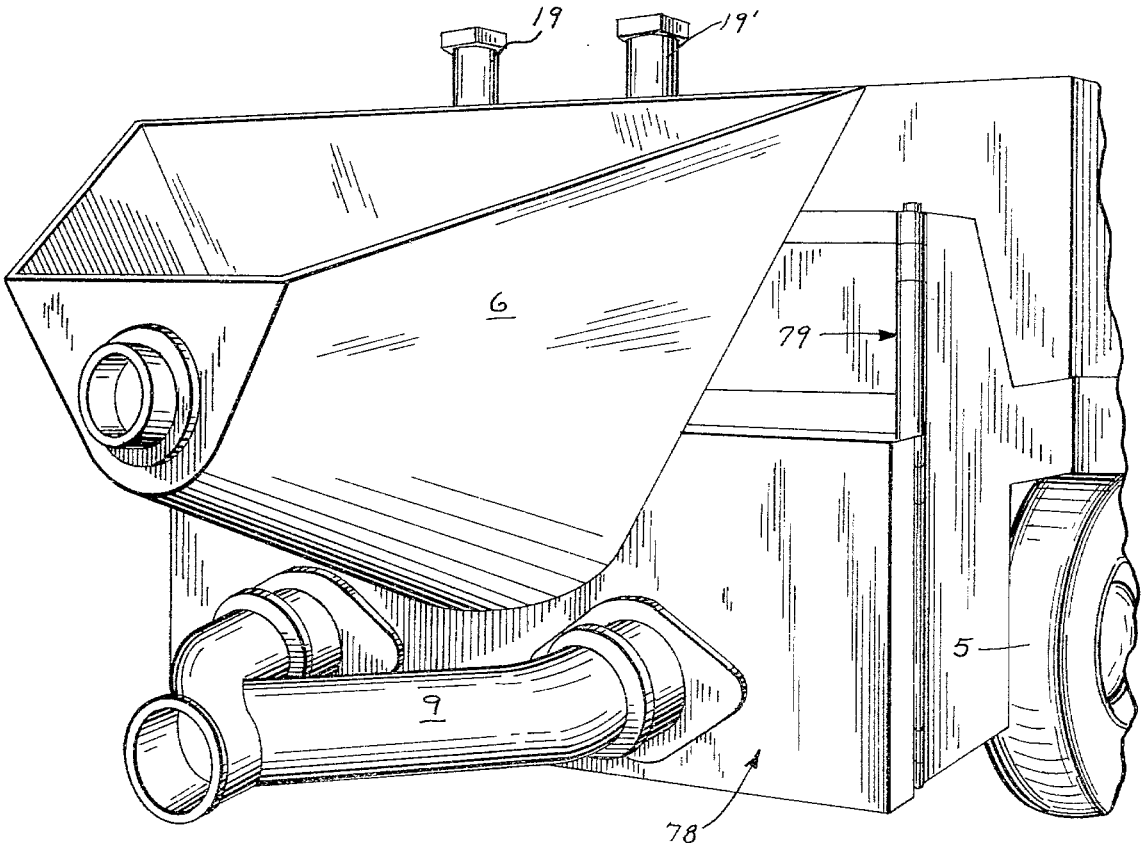
FIG. 5 is a pictorial view of a concrete hopper unit shown in FIGS. 1-4.

The wear plates 65 and 66 are readily accessible by swinging of the hopper support unit to the open position as shown in FIG. 6. Thus, the hopper and inlet unit 9 are mounted to a swinging door 78 which is pivotally attached along one side of the apparatus to the back support structure 32, as at 79.

Further, a resilient seal ring, not shown, may be provided circircling the floating valve plate for sliding engagement with the rotating valve plate. The normal high speed operation, particularly the charging stroke, creates substantial pressure differential, which may eventually cause air leakage because of plate wear with use. Although this would not seal between the plate openings, the undesired air leakage would be.

The apparatus is preferably constructed with the four wheels 5 mounted for road engaging positioning as in FIG. 1 or raised to permit lowering of the apparatus into pumping position with the framework 4 fixedly supported on the ground by suitable rigid support legs 80 adjacent each wheel 5 as shown for example in FIG. 2. In the illustrated embodiment of the invention, each wheel axle is secured to the outer end of a pivot arm 81, the opposite end of which is pivotally supported within the adjacent leg 80. The leg 80 is shown as a channel member having a flat bottom support wall 82. The leg 80 is welded as at 83, or otherwise rigidly affixed to the side frame 4 and depends therefrom. The wheel pivot arm 81 is pivotally mounted on a suitable pivot pin 84 within the leg 80. A tubular air bag unit 85 has one end bolted or otherwise fixed within the channel-shaped leg 80 with an air valve 86 for selectively supplying and removing of air from the bag 85. A piston 87 projects into the bag 85 in the manner of a rolling diaphragm. The piston 87 is interconnected to the wheel arm 81 by a suitable triangular shaped bracket 88 such that the wheel load tends to force the piston 87 into the air bag unit 85. The bag 85 is blown up to force the piston 87 outwardly causing the wheel arm 81 to pivot and move the wheel 5 downwardly into ground engagement. The air bag 85 of course, also functions as a shock absorber during the transport mode of operation. Conversely, when the air is bled off, the weight of the apparatus pivots or collapses the pivot arm 81 and wheel 5 upwardly, with the piston 87 moving into the bag structure as more clearly shown in FIG. 2. The result is the lowering of the rigid support leg 80 downwardly into ground engagement. Obviously any other suitable desired design can be employed but that illustrated has been found to be a highly satisfactorily reliable support.

The pump positioning means and the pump operators may be controlled by any suitable control circuit having means to rather precisely establish the positioning of the pump assemblies and creating the appropriate speed of charging and discharging to establish the continuous flow into and through line 3. The quantity of concrete delivered is controlled by controlling of the speed of the pump assemblies 8 and 8'. In the illustrated embodiment of the invention, a plurality of pump valve units 90, 91, 92, as shown diagrammatically in FIG. 3 couple the engine-driven pump assembly to an output line 93. Valves 90 through 92 are solenoid actuated valve means to control the flow and volume of hydraulic fluid supplied to the several valve and power means.

Figure 11:
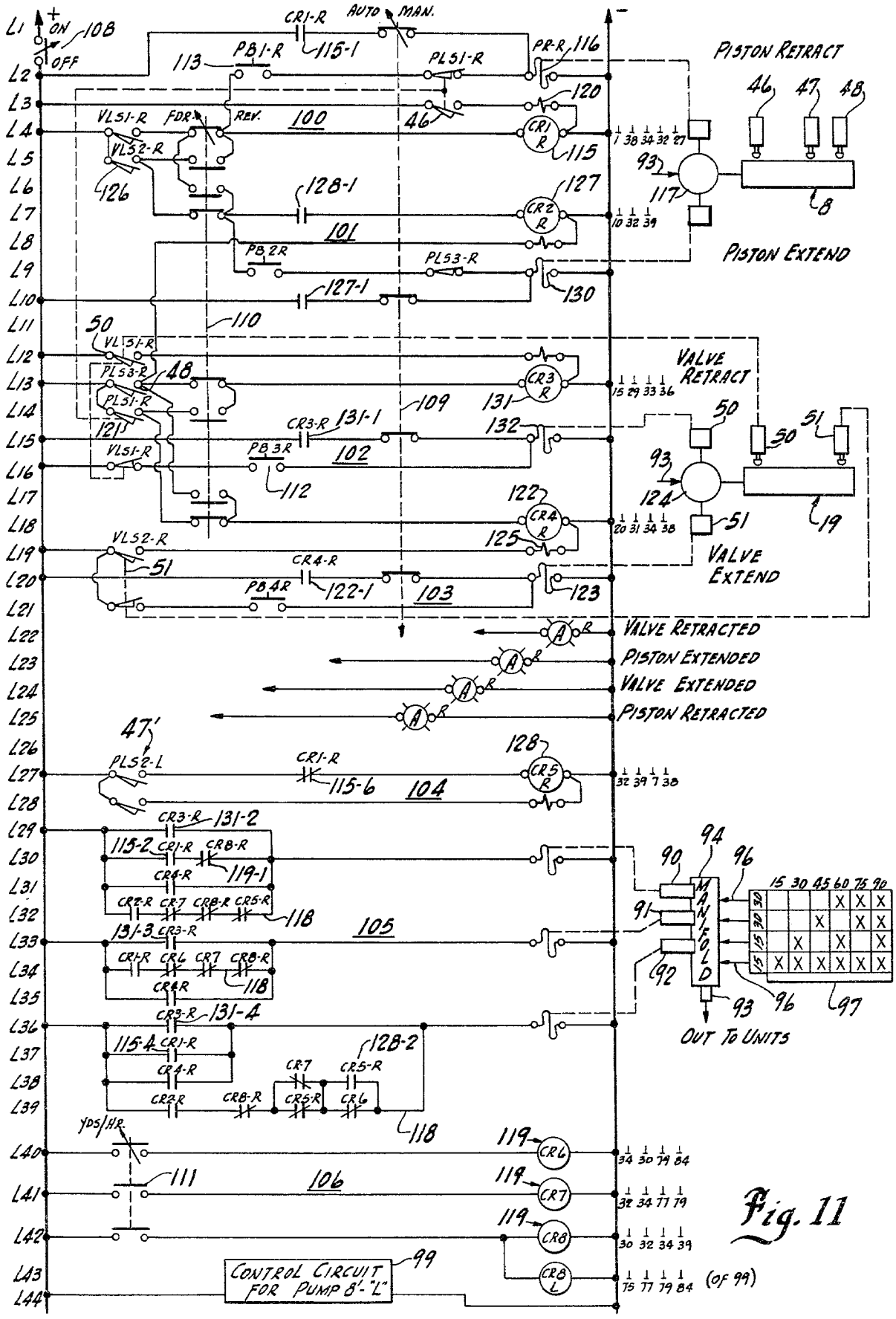
FIG. 11 is a schematic circuit diagram illustrating one operable control system.

Referring particularly to FIGS. 1, 3, and 11, the hydraulic system is shown including a manifold 94 connected to output line 93 which is connected to supply the pump actuating sections 13 and 13' as well as to the vertical positioning cylinder units 19 and 19'. As the pump section 13 and the positioning unit 19 never operate simultaneously, the manifold 94 can be coupled to the units for proper timed operation thereof. The manifold 94 is coupled in parallel to the pump output through a direct minimum flow connection 96 as well as the three solenoid valves 90 through 92. The output of the valve means may provide the same or distinctly different flows. In one embodiment, the output of the pump unit included a direct or minimum fifteen gallons per minute output, a similar valved output and two valved thirty gallons per minute outputs. The total output is controlled by appropriate action of the solenoids, as shown in the logic diagram 97 in FIG. 11. The logic diagram 97 is shown in a conventional matrix with the different total output in gallons per minute identified at the upper ends of the diagram columns and the input flows in the several rows. The matrix conditions are satisfied by appropriate identified energizing of the solenoids valves 90 through 92, as shown by the "X" identified intersections. In the illustrated embodiment of the invention, flow increments of 15 gallons per minute were used including flows of 15, 30, 45, 60, 75 and 90 gallons per minute, as shown. The solenoids, as more fully developed hereinafter, are selectively energized, in part, in response to the setting of the speed selector which is connected to the control circuit, shown for example in FIG. 11. In addition, each of the valves 90 through 92 is preferably combined with a relatively small pilot valve 98 which permits accurate control and tuning of the flow rate for the particular valve. This is desirable to allow accurate control of the discharge rate of pump assemblies 8 and 8' to maintain a continuous outward flow of the concrete into the main flow line 3. A suitable operating circuit employed in connection with apparatus such as shown in FIGS. 1 through 10 is shown in FIG. 11, with the positioning and operating means as well as the hydraulic flow control system diagrammatically illustrated.

The pump assemblies 8 and 8' are individually and separately controlled and positioned to permit precise discharging of concrete with a timed overlap to maintain a constant and continuous flow through line 3. Thus the one pumping cylinder 39 is charging at a greater rate than the opposite cylinder 39' is discharging, and is positioned into the discharge position prior to complete discharge of discharging cylinder. At a predetermined point of the discharging cylinder 39, the two cylinders 39 and 39' operate at half speed until the partially discharged cylinder is fully discharged, at which time the empty cylinder is cut off and recycled for charging while the other partially discharged cylinder transfer to full speed discharge operation, thereby maintaining the desired continuous flow of concrete into and through flow line 3. When the partially discharged second cylinder moves to the terminal portion, the opposite cylinder has again been charged and positioned for discharge, and the simultaneous discharge is again established with subsequent cycles continuing.

Further, the system may of course be reversed with the cylinders charged in the above described discharge position and discharging of the concrete to the hopper 6. Referring particularly to FIG. 11, the valve positioning units 19 includes a fourway valve unit connected to the line 93 for selectively supplying hydraulic fluid to the operating cylinder for retraction and extension of the positioning unit 19. The fourway valve is electromagnetically operated as presently described. The operating section 13 of pump assembly 8 is similarly connected to the supply by a fourway valve.

Referring to FIG. 11, an across-the-line circuit diagram is shown for the pump assembly 8 and only certain interlocking to the pump assembly 8'. The coupling to the positioning valve unit 19 and to the power section 13 of pump assembly 8 are also diagrammatically shown. The circuit for operating of the pump cylinder 8' is a complete duplicate and is thus shown as block 99. The circuit for assembly 8 includes the branch lines connected between electrical power lines connected to a suitable power source such as a twenty-four volt battery, not shown, and shown as parallel horizontal lines which are numbered L1 through L43 for reference purposes. The pump assembly circuit generally includes a piston retract section 100 including lines L1 through L5; a piston extend section 101 including lines L6 through L10; a valve retract section 102 including lines L12 through L17 and a valve extend section 103 including lines L18 through L21. In addition, an overlap interlock section 104 is shown at lines L27 and L28 which provide for the alternate actuation and interlocking of the circuits for the pump assembly 8 and the pump assembly 8' during the discharge portion of each cycle. In addition to the illustrated embodiment of the invention, the solenoid operating branch circuit 105 for solenoids 90 through 92 is shown including lines L29 through L39 inclusive and the speed selector section 106 including lines L40 through L43 inclusive. The circuit shown is constructed for automatic continuous system operation as well as a limited manual control such as for set up and the like. Referring to FIG. 1, a simplified illustration of control panel 107 is shown with a plurality of actuating controls shown as suitable push button and rotary selector switches. The control panel thus includes four rotary switches including a main on-off switch 108, an automatic-manual selection switch 109, a forward-reverse switch 110, and a multiple quantity or speed control switch shown having settings of 20 35, 50 and 75 yards of concrete per hour. The control switches 108-111 are shown as rotary type switches. Push-button control switches are also shown for manual operation of the pump assemblies 8 and 8', in either a forward or a reverse direction. The switches include first pair of discharge control buttons 112 for controlling the valve positioning unit 19 and a second pair of discharge control buttons 113 for reversely actuating the operator section 13 of the pump assembly 8.

In FIG. 11, the switches 108 through 110 are set for automatic operation and with a forward drive for transferring concrete from the hopper 6 into the transfer line 3. The automatic-manual switch connections as well as the interrelated push button switches will be readily understood by those skilled in the art and a detailed description thereof is not given.

In the circuit, various conventional and identifying legends have been used. The several limit switches in addition to being identified in accordance with the previous numbers are also identified with identifying legends associating them with the valve positioning unit 19 by the letter "V" and with the power operator sections 13 for the pump assemblies by the letter "P" as well as the usual conventional identification employed in industry. The letter "R" and "L" are added respectively for identifying the assembly relating to the actuator 8 and 8'. The power cylinder solenoids and the valve positioning solenoids are similarly identified with an associated additional letter "R" for retract and "E" for extend. The relays and other components are identified by conventional symbols and legends. The numbers along the right side of the drawing indicate the cross line position of contacts associated with the relay on the same branch line. A vertical line above the number indicates a normally open contact while an inverted "T" indicates a normally closed contact.

The circuit of FIG. 11 will be described with reference to a pumping cycle of operation, and assuming cylinder 39 of the pump assembly 8 is in the charge position aligned with the opening 10 of hopper 6 and pump assembly 8' is discharging into the Y-section inlet pipe unit 9. In this position the limit switch 50 (VLS1R) is closed as a result of a full retraction or raising of the valve cylinder unit 19, and a relay 115 (CR1) in line L4 is energized. The several contacts of relay 115 includes a set of contacts 115-1 in line L1 providing power to the retraction solenoid 116 which operates the fourway valve unit 117 to power section 13 to supply fluid to retract the cylinder 39 of pump assembly 8. The associated piston pump 41 in cylinder 39 retracts correspondingly and concrete is forced from hopper 6 into the cylinder 39. The speed at which the assembly 8 moves is determined by the position of the speed or quantity selector switch 111 and the selection circuit section 105 which includes a separate branch line for each solenoid 90 through 92. Relay 115 also controls contacts 115-2 in lines L30 to the solenoid 90, contacts 115-3 in line L34 to the solenoid 91, and contacts 115-4 at line 37 to the solenoid 92. The relay contacts in line L37 for solenoid 92 provide direct energization and solenoid 92 is energized during each charge to insure provision of a minimum supply of 30 gallons per minute. Depending upon the setting of speed selectors switch 111, solenoids 90 and/or 91 are energized for increasing the flow and retraction or charging rate. Each of the solenoid branch circuits is constructed to establish the desired flow logic in accordance with the state of the system, and in particular the quantity of concrete to be pumped whether the pump assembly is being rotated between its alternate positions, or is being charged or discharged. In particular, each of the solenoid branches includes a speed discharge control line 118 shown at line L32 for solenoid 90, at line L34 for solenoid 91 and line L39 for solenoid 92. The separate lines 118 includes the discharge interlock contact from the operating sections as hereinafter described and contacts from the speed selector switch circuit 106. The selector switch 111 has a plurality of contacts, one in each of the selected lines L40-42 and selectively energizes the several relays in each position to establish certain combinations of the hydraulic pump volumes at different stages of the pumping cycle. Speed selector switch 111 is thus shown as having three sets of contacts or switches, each connected in series with a related relay 119. The relays 119 control contacts in the several branch circuits 118 for controlling of the charging and discharging rates. Thus, if the speed selection relay 119 (CR8) in line L42 is not energized, the associated contacts 119-1 in line L30 are closed, solenoid 90 is also energized, thereby providing at least a 60 gallons per minute. Similarly, if all of contacts in the line L34 remain closed, solenoid 91 is also energized and establishes a maximum flow charge rate, namely 90 gallons per minute. Thus, the cylinder 39 of pump assembly 8 charges at a selected rate. When the cylinder 39 of pump assembly 8 has been fully retracted to its extreme position, thereby indicating full charging thereof, the limit switch 46 (PLS1R) is actuated. Switch 46 is connected in line L3 to operate an unlatch coil 120 for relay 115 (CR1) and when closed relay 115 drops out. The limit switch 46 is a multiple contact unit and includes a second switch unit 121 connected in line L14, which, when closed, energizes a valve extend relay 122 (CR4) in line L18. Relay 122 closes contact in the several lines as indicated and in particular establishes power to the valve extend coil or solenoid 123 (VER) in line L20. The coil is coupled to the fourway valve 124 of cylinder positioning unit 19 which now reverses the hydraulic supply causing the unit 19 to extend, pivoting of the pump assembly 8 to the discharge position in alignment with the inlet pipe 14 of the Y-pipe unit 9. When the pump cylinder reaches this position, the associated actuator operates the switch 51 (VLS 2R), connected in line L19. This actuates an unlatch coil 125 for the relay 122 (CR4), and a second set of contacts or switch 126 of limit switch 51 connected in line L5 arms that line to provide power to the power extend relay 127 (CR2) in line L7. Normally open relay contacts 128-1 of interlock relay 128 (CR5-R) are connected in series in line L7.

The relay 128 (CR5-R) is an interlock relay forming a part of interlock circuit 104 at lines L27-L28. Relay 128 is connected in series with normally closed contacts 115-6 of the piston retract relay 115 (CR1-R), and with the limit switch 47' (PLS2L) for the opposite pump assembly 8'. Relay 128 (CR5R) cannot be energized to provide extend power whenever the retract relay 115 is energized. As the power actuating unit 13' of then discharging pump assembly 8' moves forwardly, the associated actuator 43' moves into engagement with the anticipitory switch 47' in the same manner as shown in FIG. 3 for assembly 8. When limit switch 47' (PLS2-L) closes, relay 128 (CR5-R) is energized to close contacts in lines L7 and energize the extend relay 127 (CR2-R), which closes contacts 127-1 in line L10 to provide power to the piston extend solenoid 130 (PE-R). The fourway valve 117 is reset by solenoid 130 to supply hydraulic fluid to the power operator section 13 of pump assembly 8 to discharge pump assembly 8. The pump assembly 8 and 8' then both discharge concrete into the Y-section.

Relay 128 (CR5) also has contacts L28-2 connected in the speed control circuit 105 and in particular at line L32 for solenoid 90 and line L39 for solenoid 92, and function to reduce the speed of both pump assemblies 8 and 8' to half normal selected speed for the remainder of the discharge stroke of the pump assembly 8 thereby maintaining the total output constant. When the opposite pump assembly 8' has completed the discharge stroke, the associated end limit switch 48' (PLS3L) is closed, to terminate its discharge cycle, arm the circuit to positioning unit 19' in its control circuit and de-energize relay 128 (CR5) to shift the pump assembly 8 into a full speed operation. Pump assembly 8 then continues to discharge concrete to maintain the desired continuous flow into line 3. The opposite pump assembly 8' being fully discharged is moved to the charge position to operate switch 50' of valve positioning unit 19' which establishes a valve retract circuit, the same as shown in lines L12 through L16 of FIG. 11 wherein a valve retract relay 131 (CR3) is connected in series with limit switch 50 (PLS3-R) for pivoting of pump assembly 8 to the charging position. Thus, relay 131 (CR3R) is connected at line L13 in series with full discharge switch 48 of pump assembly 8. Relay 131 actuates contacts 131-1 in the fourway valve solenoid line L15 for energizing of the valve retract solenoid 132 which is coupled to reset the fourway valve 124 to actuate the valve positioning unit 19 to retract and thereby pivot the pumping assembly 8. Relay 131 (CR3) also controls contacts 131-2 in line L29 to solenoid 90 and contacts 131-3 in line L33 to solenoid 91 and contacts 131-4 line L36 to solenoid 92. All solenoids 90–92 are energized, establishing maximum flow and thereby maximum speed for the pump assembly 8 during this pivoting motion.

In the above described sequence the pump assembly 8 thus continues to discharge at full speed during which period the duplicate circuit 102 for the opposite pump assembly 8' is operative to pivot the pump assembly 8' to its charging position. The system has thus completed one cycle and is in the proper position, and does function to rapidly charge pump assembly 8' by operation of a circuit in unit 99 corresponding to that shown in lines L1 through L4, and beginning a similar cycle as that described above which began with charging of pump assembly 8 while pump assembly 8' was discharging. The cyclically charging and discharging of the pump assemblies 8 and 8' with the timed overlapping discharge continues automatically and repeatedly with the alternate positioning the pump assemblies and particularly cylinders 39 and 39' thereof until the system is turned off as by the opening of the main on-off switch 108 to remove power from the system.

The illustrated system also includes a distinct safety interlock in that neither of the pump assemblies 8 or 8' can be actuated to move in either direction unless the positioning valve is in one of the extreme positions to align the corresponding pumping assembly with the hopper 6 or with the inlet line 14 for discharge to line 3. This interlock is maintained for both manual and automatic control. However, the fourway valves may be provided with additional manual override such as to permit movement of the pump assemblies directly.

A practical application may be encountered in the building of a high rise hotel structure wherein concrete or the like may be pumped to heights in excess of 200 and 300 feet. In such a system, a 5 inch flow line would be employed, with the pump operating at output pressures on the order of 500 psi and generally within a range of 300 to 800 psi. This will provide a range of 40 to 78 yards of concrete per hour to the deposit site. Internal pulsating pressures on the order double the normal pressure may be encountered within the flow line if any significant change in the flow rate occurs with the reaction forces tending to create very significant movement of the flow line. The present invention when applied to such an application establishing an essential flow of concrete and maintains an essentially still line, without any significant adverse effect created. The size of the line, the pressure employed and the like of course varies with particular concrete pumping specifications such as the length of the flow line, the concrete mix and the like. In practically all instances, similar considerations and problems are presented in varying degrees and all of which are minimized if not completely eliminated by employing the independently operable pumping units with the interrelated control to thereby establish the desired smooth constant flow characteristic in accordance with the basic teaching and structure of this invention. The present invention can be and has been employed without the use of any reaction blocks without adverse movement of the flow line.

The illustrated embodiment of the invention provides a preferred construction of the present invention. Various modifications and changes can of course be made therein within the significant concept of the essentially independent positioning and controlling the charging and discharging of a plurality of pump means. This novel approach permits the proper charging and discharging and creation of a true essentially continuous overlap in the outflow to maintain the desired flow characteristic, particularly useful in the high pressure pumping of concrete and the like, while avoiding complex mechanical coupling and valving means.

Various modes in carrying out the invention are contemplated as being within the scope of the following claims, particularly pointing out and distinctly claiming the subject matter which is regarded as the invention.

We claim:

1. A pumping apparatus for establishing a constant and uniform pressurized discharge flow of semi-fluid material through a flow system adapted to be connected to such apparatus, comprising a supply means containing a supply of semi-fluid material and having discharge means for delivery of the semi-fluid material therefrom, a plurality of receiving means located in predetermined spaced relation to said discharge means for receiving said semi-fluid material and transferring said material to a remote location, a plurality of pump assemblies movably mounted with respect to said discharge means and said receiving means to a charging position and a discharge position for selective charging and discharging with material, control means coupled to actuate said pump assemblies and operable to charge the pump assemblies substantially more rapidly then to discharge the pump assembly, said control means including positioning means alternately positioning the pump assemblies in said two positions and including a period of a simultaneous discharge positions during each positioning of the pump assemblies for simultaneously establishing pressurized flow from said pumps to said receiving means and thereby establishing a continuous and uninterrupted movement of the semi-fluid material through said receiving means, said control means including first position control means for actuating the first pump assembly and second position control means for actuating the second pump assembly, each of said pump assemblies including signal means for establishing unique signals including a first signal with the pump assembly fully charged, a second signal shortly before the pump assembly is fully discharged and a third signal when the pump assembly is fully discharged, a fourth signal in response to positioning of the pump assembly in the charging position and a fifth signal in response to positioning of the pump assembly in the discharging position, and circuit means connecting said signal means into said first and second control means to cyclically actuate said pump assemblies including a pumping cycle in which the first pump assembly is charging and the second pump assembly is discharging, said charging being at a substantially faster rate than said discharging and in sequencing including a condition in which said first pump assembly is fully charged and in said discharge position prior to said second pump assembly and actuating said corresponding signal means to establish said second signal and said second pump assembly actuates said second signal means to establish said second signal means to actuate the fi st pump assembly to discharge simultaneously with the second pump assembly and said second pump assembly actuating the second signal means to establish said third signal and actuating the positioning means to place the second pump assembly in the charging position for charging of said second pump assembly and initiating a second cycle with the first and second pump assemblies reversed in the identical sequence to the first cycle, said first and second control means continuously establishing said first and second cycles to maintain a constant discharge.

2. The apparatus of claim 1 wherein said positioning means and said first and second pump assembly include hydraulic operators, a pressurized hydraulic supply means is connected to supply pressurized liquid to said operators and includes supply control means to vary the rate of the supply for varying the speed of said operators, said first and second position control means including means to actuate said supply control means to operate said pump assemblies a selected maximum discharge rate during the period of individual sole discharge and at one-half of said maximum discharge rate during the periods of simultaneous discharge and to operate said positioning means at a selected rate.

3. The apparatus of claim 2 wherein a rate control means includes a common input selection means for correspondingly actuating said hydraulic control means to selectively select said maximum discharge rate.

4. A concrete pumping apparatus for establishing a constant and uniform pressurized discharge flow of semi-fluid material such as concrete and cement through a flow system adapted to be connected to such apparatus for depositing of said semi-fluid material at a location remote to a supply, comprising a supply means containing a supply of semi-fluid material and having a plurality of discharge means for delivery of the semi-fluid material therefrom, a plurality of receiving means located in predetermined spaced relation to said discharge means adjacent said supply means, a plurality of piston-cylinder pump assemblies each including a piston cylinder unit rotatably mounted for rotation about an axis parallel to the axis of the piston-cylinder unit and with respect to said discharge means and said receiving means for selective charging and discharging with material, drive means for individually and separately moving each pump assembly between two fixed positions including a first charging position in which the pump assembly is in alignment with one of said discharge means for charging the pump assembly with material and in a second discharging position in which the pump assembly is aligned with and in free unobstructed connection with one of said receiving means to discharge said material from the pump assembly, control means to actuate said drive means to alternately move said pump assemblies between the charging position and discharging position including an intermediate common position in which a plurality of said pump assemblies are simultaneously in the second discharge position, in said intermediate common position one of said pump assemblies beginning a discharge cycle and another of said pump assemblies finishing a discharge cycle to establish a continuous and uninterrupted flow of the semi-fluid material through the flow system, and said receiving means are located external to and separate from the supply means, including a floating valve plate means coupled to each pump assembly and located in sliding sealing engagement with said discharge means and said receiving means as the pump assembly moves therefrom, and means urging said floating valve plate means into said sliding sealing engagement.

5. A high pressure pumping apparatus for establishing a constant and uniformed pressurized discharge of a semi-fluid material such as concrete and cement through a flow system operating at a pressure of substantially 500 PSI, comprising a supply means for containing a supply of semi-fluid material, said supply means having a plurality of discharge means for delivery of the semi-fluid concrete therefrom, a plurality of receiving means located in predetermined spaced relation to said discharge means, a plurality of pump assemblies movably mounted with respect to said discharge means for selective alignment of said assemblies with a corresponding one of said discharge means for charging thereof and with a corresponding one of said receiving means for discharge thereof, separate drive means for individually and separately moving each pump assembly into operative alignment with one of said discharge means for charging the pump assembly with material and with one of said receiving means to discharge said material from the pump assembly, and a plate means positioned with each pump assembly and operable to close the corresponding discharge means and receiving means in response to the movement of said pumping assembly from alignment therewith, control means to actuate said drive means to move said pump assemblies in a continuous cyclical sequences including a first stage in which one pump assembly is in a charging position with a second pump assembly in a discharging position and a second stage in which both pump assemblies are in the discharge position and a third stage in which said second pump assembly is in a charging position and the first pump assembly is in a discharging position and a fourth stage in which both pump assemblies are in the discharge position, said pump assemblies being pivotally mounted, a hydraulic actuator coupled to the pump assemblies for selectively pivoting of said assemblies into alignment with the outlet pipe means and the inlet means, a valve plate secured to the discharge end of a pump cylinder and defining a common plane with the discharge end of the pump cylinder, said plate projecting in opposite directions from said pump cylinder for a sufficient distance to move into overlying relationship to said discharge means and said receiving means in response to the opposite positioning of said pump cylinder, and a hydraulic piston-cylinder actuator coupled to said plate for pivoting of the plate and the pump assembly about said pivot shaft into alternate alignment of the pump cylinder with the discharge means and with the receiving means.

6. The pumping apparatus of claim 5 wherein said floating valve plate assembly includes a valve plate including a first conduit telescoped with the discharge means and a second conduit telescoped with the receiving means, said telescoping conduits each including a sealing means providing a fluid type seal with the corresponding opening means, a hydraulic piston cylinder unit fixedly mounted to the framework and including an output connected to said floating plate and urging said plate outwardly into sliding engagement with the rotating plate of the corresponding pump assembly.

* * * * *